US008365931B2

(12) United States Patent
Rees et al.

(10) Patent No.: US 8,365,931 B2
(45) Date of Patent: Feb. 5, 2013

(54) DEVICE FOR RESTRICTING AIR CONTACT WITH WINE IN AN OPENED WINE BOTTLE

(76) Inventors: Barry Maxwell Rees, Docklands (AU); Malcolm McKenzie, Tallarook (AU)

( * ) Notice: Subject to any disclaimer, the term of this patent is extended or adjusted under 35 U.S.C. 154(b) by 1546 days.

(21) Appl. No.: 11/574,264

(22) PCT Filed: Dec. 12, 2005

(86) PCT No.: PCT/AU2005/001875

§ 371 (c)(1),
(2), (4) Date: Jul. 5, 2007

(87) PCT Pub. No.: WO2006/063389

PCT Pub. Date: Jun. 22, 2006

(65) Prior Publication Data

US 2008/0110847 A1 May 15, 2008

(30) Foreign Application Priority Data

Dec. 16, 2004 (AU) ..... 2004907174

(51) Int. Cl.
*B65D 39/02* (2006.01)
*B65D 81/24* (2006.01)
*B65B 25/06* (2006.01)

(52) U.S. Cl. ..... 215/231; 220/578; 220/579; 426/398

(58) Field of Classification Search ..... 215/231, 215/264, 263, 386, 400; 220/216, 578, 579, 220/220, 694, 227, 580; 222/386.15, 564, 222/547; 426/392, 397, 398
See application file for complete search history.

(56) References Cited

U.S. PATENT DOCUMENTS

| | | | | |
|---|---|---|---|---|
| 3,049,261 | A * | 8/1962 | Wade et al. | 220/216 |
| 3,357,591 | A * | 12/1967 | David | 220/222 |
| 4,312,459 | A * | 1/1982 | Leach | 220/256.1 |
| 5,415,317 | A * | 5/1995 | Hager | 220/579 |
| D397,275 | S * | 8/1998 | DuBay, Sr. et al. | D7/667 |
| 2003/0102311 | A1 * | 6/2003 | Brady | 220/216 |

FOREIGN PATENT DOCUMENTS

GB 2187704 A * 9/1987

* cited by examiner

*Primary Examiner* — Robin Hylton
(74) *Attorney, Agent, or Firm* — Carlson, Gaskey & Olds PC

(57) ABSTRACT

The specification discloses a device (10) insertable into a wine bottle (12) after opening, the device (10) being intended to float on the surface (21) of wine remaining in the bottle (12) and minimize deterioration of the remaining wine, said device (10) including a core structure (11) having a thin spring plate (11*a*) capable of being deformed when the device (10) is inserted into the bottle (12) and capable of recovering its shape once inserted into the bottle (12), the core structure (11) further having at least one floatation means (11*b*) and said device (10) including a liquid impervious outer sheath (18) having upper and lower walls (14, 15) sealed to one another to retain the core structure (11) therein, the outer sheath (18) being of a material that is non reactive with wine and including a flexible outer peripheral edge zone (42) with cuts or the like (49) formed therein, the outer peripheral edge zone (42) being adapted, in use, to contact the internal surfaces of the wine bottle (12) while floating on wine remaining in the bottle (12).

21 Claims, 7 Drawing Sheets

12
13
14
15
16
18
21
22
23
24
25
26
27
28
10'

DEVICE FOR RESTRICTING AIR CONTACT WITH WINE IN AN OPENED WINE BOTTLE

The present invention relates to minimising or slowing the degradation by oxidation of wine in a bottle once opened such that it may be consumed over a period of time that could be up to several days without any significant deterioration of the wine, in both smell and taste characteristics.

There is a growing market for purchasing wine and, particularly premium wines, by the glass requiring restaurant, wine bars, hotels and similar outlets to have a convenient and economical system for preserving wine in the bottle once opened. Similar issues also apply with domestic consumers of wine. There are a number of known arrangements that seek to preserve wine in an opened bottle which include placing a temporary stopper or seal in the bottle and evacuating the air from the bottle above the remaining wine. These arrangements remove smell (nose) characteristics from the wine during evacuation. Other arrangements include placing an inert gas such as nitrogen or argon into the bottle to displace the air therefrom which may be used alone or also with a temporary stopper or seal. Most known systems work reasonably well when an opened wine bottle is to be stored overnight, however, they are sufficiently complicated and costly to use each time a glass of wine is poured from a bottle, that many commercial suppliers of wine by the glass will not use them during a days operation with the result that wine can deteriorate during the day and sufficient spoilage can occur to require a percentage of such wine to be discarded.

The aim of the present invention is to provide a simple and inexpensive device that can be used with an opened bottle of wine after a first glass has been poured therefrom that will thereafter protect the remaining wine in the bottle from excessive detrimental oxidation while still permitting wine to be easily poured from the bottle when desired.

Accordingly, in a first aspect, the present invention provides a wine protector device adapted, in use, to protect wine in an opened wine bottle having a neck region and a body region, said wine protector device being formed in a first expanded condition as a disc member having an outer peripheral edge zone approximating the internal cross-sectional dimensions of the body region of the opened wine bottle, said protector device being flexibly deformable to enable introduction through the neck region of the opened wine bottle and once in said body region being recoverable in shape to said first expanded position to be located on the wine surface of wine remaining in said body region, whereby a barrier is established restricting air contact with the remaining wine in the opened wine bottle.

In accordance with a second aspect of this invention there is provided a method of dispensing wine from a wine bottle, said method including the steps of:

(i) opening the wine bottle;

(ii) dispensing some wine from the wine bottle;

(iii) introducing into the opened wine bottle a wine protector member through a neck region of the wine bottle, the wine protector member being adapted to recover a disc like shape within the wine bottle having an outer periphery approximating the internal cross-sectional dimensions of the opened wine bottle whereby the wine protector disc member floats on a wine surface of the wine remaining in the opened wine bottle to restrict air contact with said remaining wine; and (iv) thereafter dispensing wine as desired from the bottle with the wine protector disc member remaining within the bottle and floating on the surface of the remaining wine.

The use of a three dimensional disc member as described above enables the oxidation of the wine remaining in the wine bottle to be delayed to extend the life of the wine. The arrangement enables the disc member to be inserted immediately after the bottle is opened and the first glass is poured therefrom. Thereafter, further glasses of wine can be dispensed from the bottle, substantially as if no protection device was being used, however the barrier to oxidation remains automatically in place and the life of the wine in the opened wine bottle is likely to be extended significantly and preferably beyond several days from the initial opening.

Preferred embodiments of the present invention will be described hereafter with reference to the accompanying drawings, in which:

FIG. 1*a* is a cross-sectional view of one possible disc protector member in accordance with one preferred embodiment of the invention;

FIG. 1*b* is a plan view of the disc protector member shown in FIG. 1*a;*

FIG. 1*c* is an exploded perspective view of the disc protector member shown in FIG. 1*a;*

Figure 9:
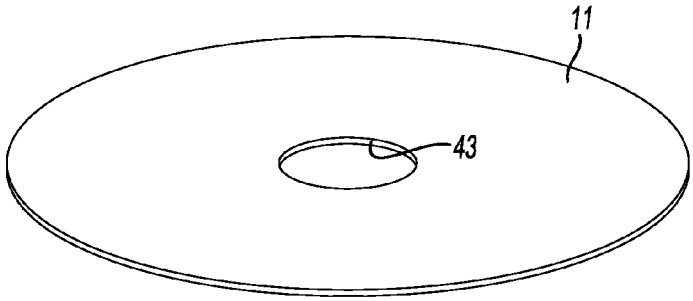
FIGS. 9, 11 and 13 are perspective views of spring disc members forming part of further preferred embodiments of the present invention.
Figure 10:
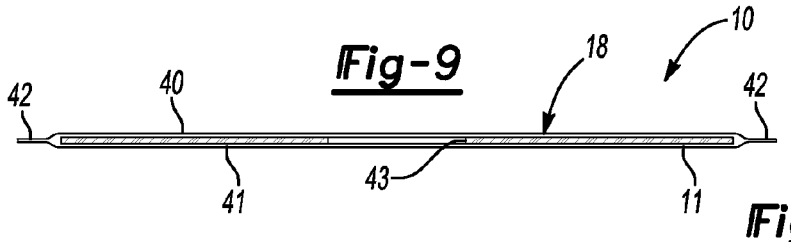
Figure 11:
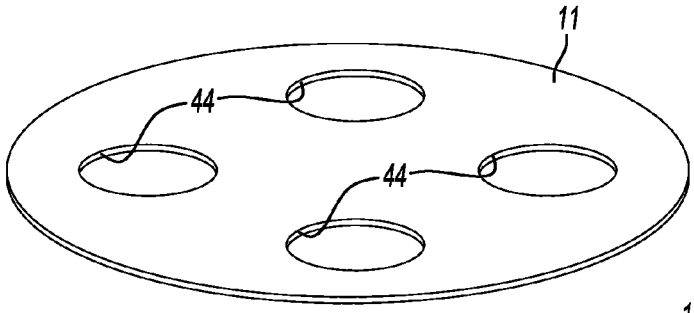
Figure 12:
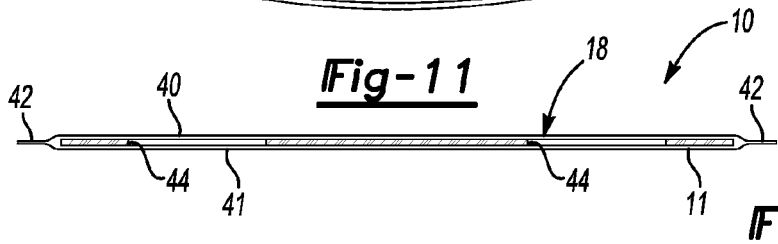
Figure 13:
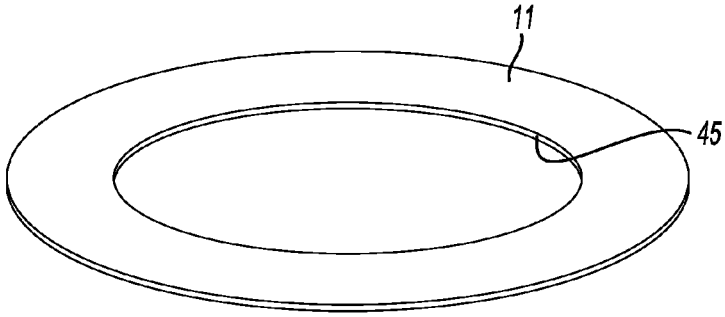
Figure 14:
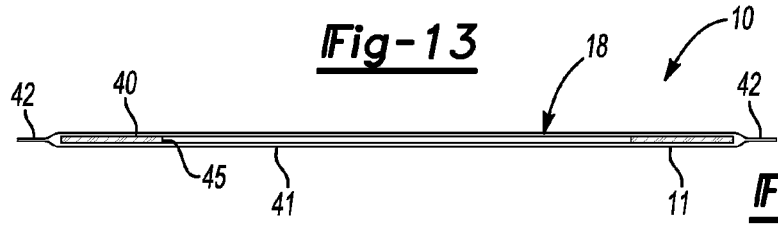
Figure 15A:
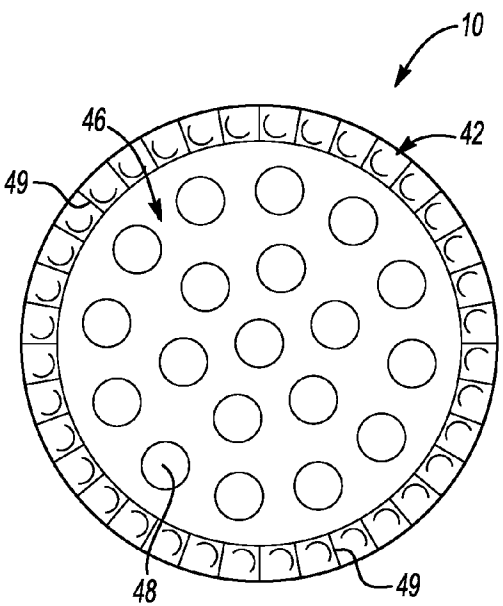
Figure 15B:
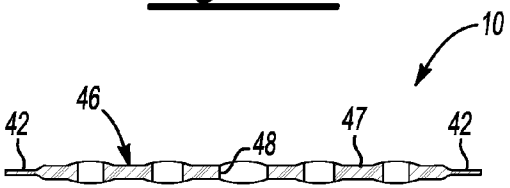

FIGS. 10, 12 and 14 are diametral cross-section views of further preferred embodiments of disc protector members utilising the spring disc members of FIGS. 9, 11 and 13; and FIGS. 15*a*/15*b*, 16*a*/16*b* and 17*a*/17*b* are respectively plan and side views of still further preferred embodiments of disc protector members in accordance with the present invention.

Figure 18:
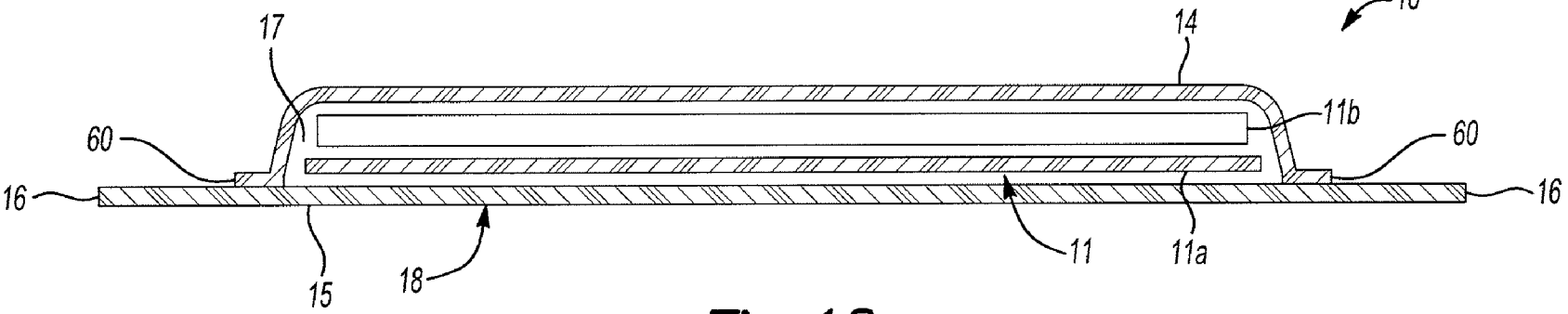

FIG. 18 shows another example disc protector member in accordance with an embodiment of the invention.

Figure 19:
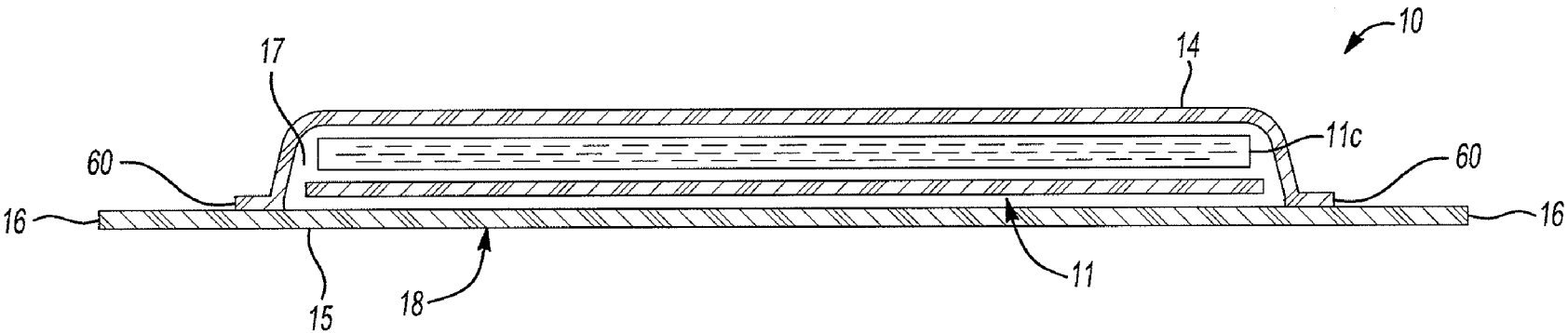

FIG. 19 shows another example disc protector member in accordance with another embodiment of the invention.

Figure 20:
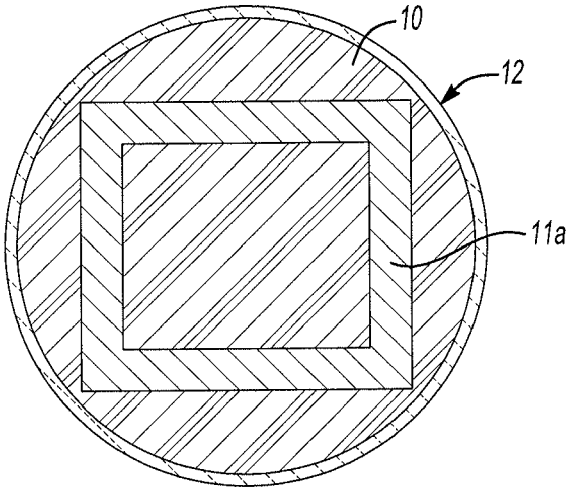
Figure 21:
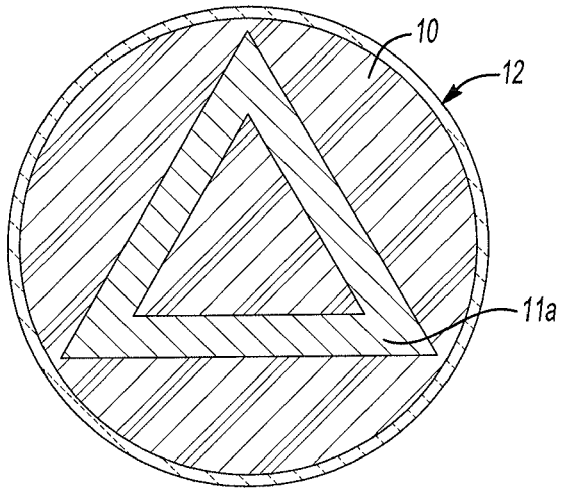
Figure 22:
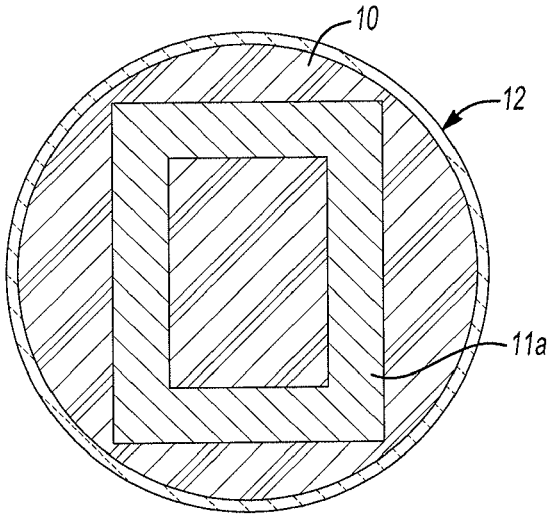

FIGS. 20, 21 and 22 respectively show cross sectional views of alternative embodiments of spring configurations in embodiments of the invention.

Figures 2, 3, 4:
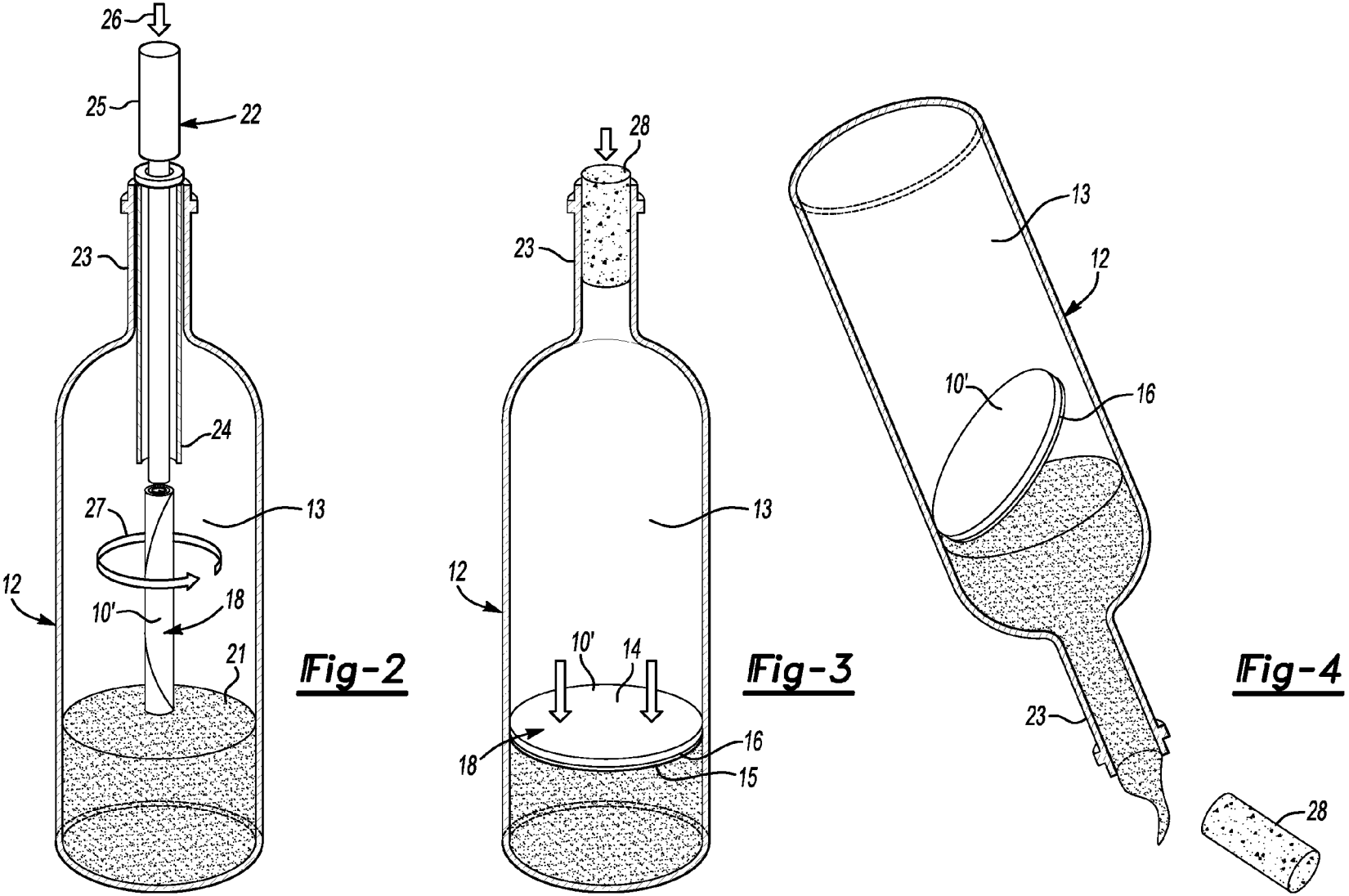
FIG. 2 illustrates a possible mechanism for introducing a disc protector member into an opened wine bottle.
FIG. 3 illustrates the opened wine bottle with a disc protector member positioned therein protecting the remaining wine in the bottle.
FIG. 4 is a view showing dispensing of wine from the bottle shown in FIG. 3 with the protector device installed.

Referring to FIGS. 1*a* to 4, a protection disc member 10 is illustrated (FIG. 1*a*) and a method of introduction of same into an open wine bottle is shown in FIG. 2. FIGS. 3 and 4 illustrate the storage and subsequent wine dispensing from the opened bottle.

Figure 1A:
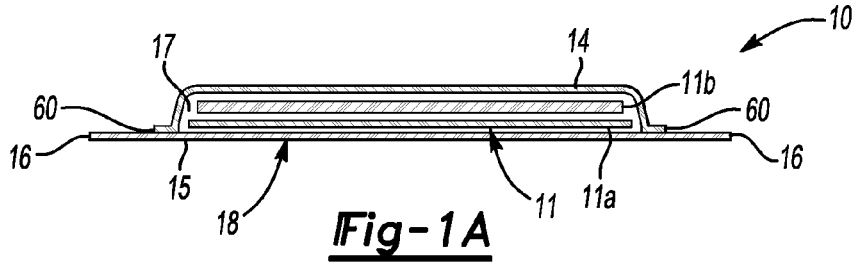
Figure 1B:
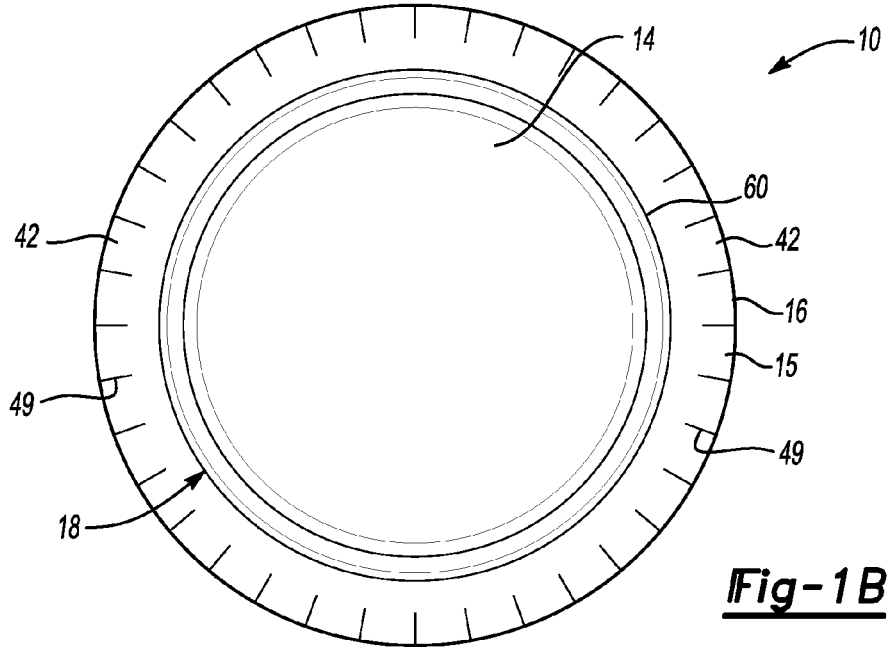
Figure 1C:
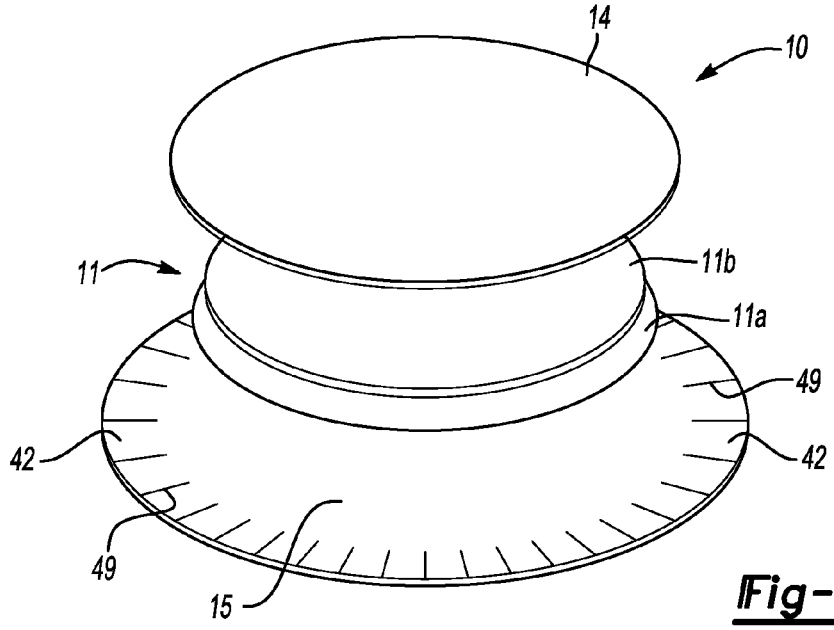

Referring to FIGS. 1*a*, 1*b* and 1*c*, a three dimensional disc like member 10 according to this embodiment includes a central layer arrangement 11 including a first layer part 11*a* being formed from a thin flat spring material. This may be a metal such as stainless steel, but alternatively, the layer 11*a* may be formed by a thin layer of plastics material that is flexible but will return to its original configuration once deforming forces are removed. The outer periphery of the central layer arrangement 11 is preferably circular with a diameter less than the internal diameter of a body region 13 of a wine bottle 12. The three dimensional disc like member 10 according to this embodiment also includes a second layer part 11*b* of a floatation material which may be an aerated plastics material such as a plastics foam or the like. This material assists the assembled device to float on the surface of the wine. The member 10 further includes an outer sheath 18 with upper and lower layers 14 and 15 of a liquid, or more particularly, liquid wine impervious plastics material film that further will not react with the remaining wine or affect the taste of the remaining wine. The peripheral edges of the outer layers 14 and 15 are sealed at 60 to ensure wine does not normally enter the zone 17 within the outer sheath 18. The peripheral dimensions of the edge 16 is preferably such that it will, in use (FIG. 3), lightly touch the internal surfaces of the body region 13 of the bottle 12. It has been found, however, that the internal wall surfaces of a wine bottle do not necessarily define a strictly circular shape nor is the shape uniform along the height of the bottle. To minimize atmosphere access to the remaining wine in the bottle, it is preferably proposed that the outer disc member 10 include a flexible zone 42 adjacent the edge 16 which also includes a plurality of cuts 49 (possibly fringed or scalloped). The cuts 49 may extend from the peripheral outer edge 16 inwardly therefrom. This will allow the device, when assembled, to easily slide down the bottle, after pouring wine from the bottle has reduced the height of the wine remaining in the bottle.

Within the zone 17, it may be desirable to include at least one flotation device such as the second layer part 11*b* and possibly two such floatation devices respectively on either side of the first layer part 11*a*. These may be air bags, sacks or the like as shown in FIG. 18 to ensure the device 10 floats on the wine surface as shown in FIG. 3. The construction may also include a separate weight means or layer 11*c* as shown in FIG. 19 that may, for example, be a liquid or gel that is in general heavier than the wine. The purpose of the weight means or layer is to ensure the device does readily drop onto the wine surface 21 in the opened bottle 12 once it is introduced into the bottle.

FIG. 2 illustrates an introduction device 22 to enable the disc-like protector to be inserted into the bottle 12 through a bottle neck region 23. The device 22 includes an elongated cylindrical barrel section 24 having an outer dimension small enough to be introduced through the bottle neck region 23 with an internal cylindrical chamber large enough to hold a rolled up protection device 10' as shown in FIG. 2. The introduction device 22 may include a plunger device 25 moveable in the direction of arrow 26 to eject the rolled up protector device 10' into the bottle 12 as shown in FIG. 2. Once the device 10' is free of the barrel section 24, it will tend to unroll (as shown by arrow 27) to reform in a disc shape (FIG. 3), to drop onto and float on the wine surface 21. In this position a substantial barrier is established between the air above the wine or any new air introduced into the region as a result of pouring wine from the bottle. If desired, the original cork 28 may be temporarily inserted into the bottle neck 23 or alternatively some other temporary stopper device might be used. When it is desired to pour a further glass of wine from the bottle, the cork or similar stopper 28 is removed and the bottle is tipped to its normal dispensing position (FIG. 4). In this position the disc protective device 10' does not obstruct the free flow of wine from the bottle.

Figures 5, 6, 7, 8:
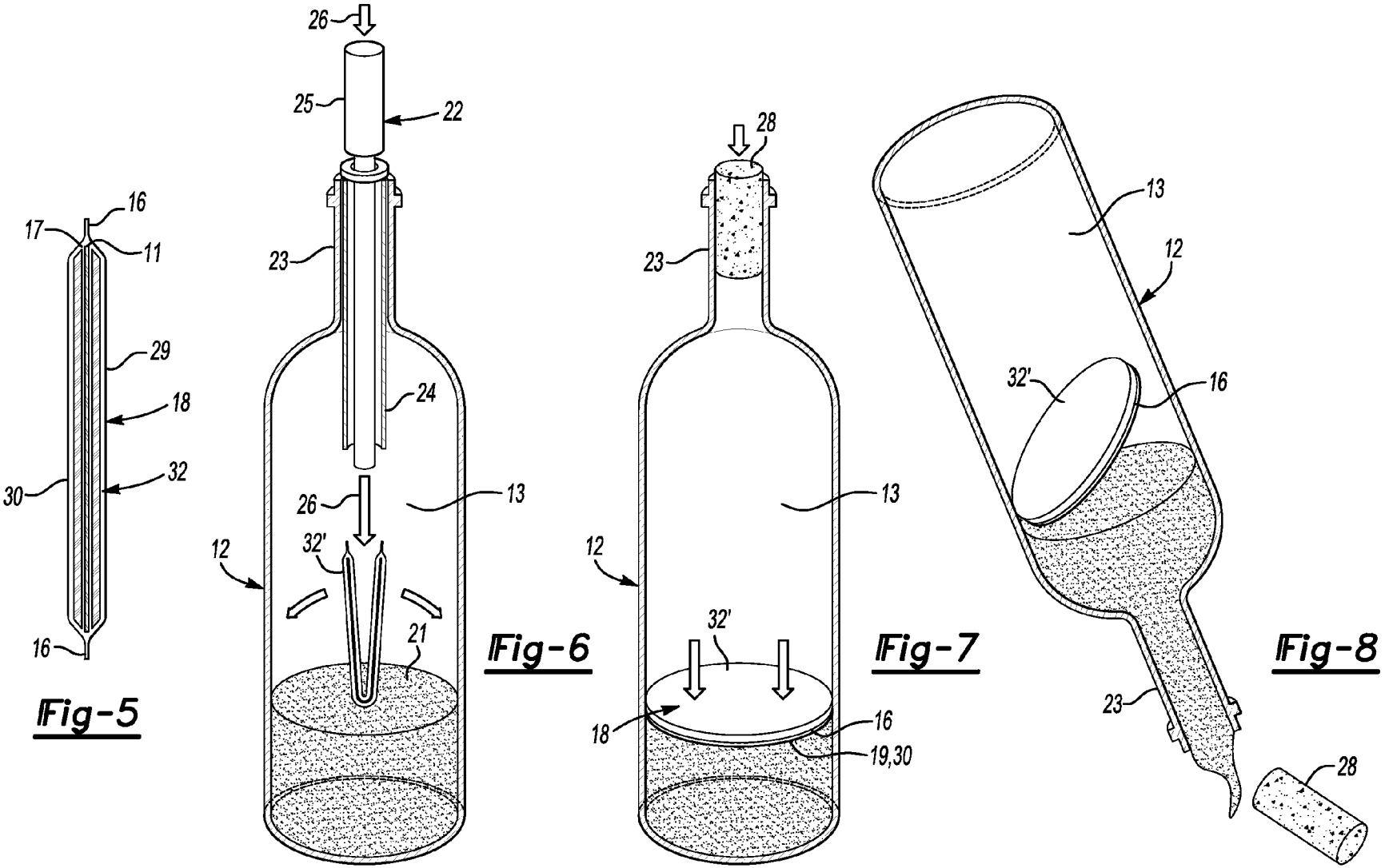
FIG. 5 is a cross-sectional view similar to FIG. 1 showing a possible alternative structure for the disc like protector device.
FIG. 6 is a view similar to FIG. 2 showing the disc like member being introduced via a different configuration into the wine bottle.
FIGS. 7 and 8 are similar to FIGS. 3 and 4 illustrating a similar method of operation for the device introduced as shown in FIG. 6.

FIG. 5 illustrates a second possible embodiment for a three dimensional disc protective device 32. The device in this case includes porous outer layers 29 and 30 that may, in use, absorb a small amount of wine to act as weight for the device. The device 32 may otherwise include a floatation device or devices 18 and 19 and a central spring member 11 made of a spring metal or a plastics material, and will work in a manner similar to the device 10 and 10' of FIGS. 1 to 4. As shown in FIG. 6, the device 10' or 32' may be folded rather than rolled to be placed in the barrel 24 of the introduction device 22, but once freed of the barrel 24, it recovers its disc like shape as illustrated by arrows 31. Otherwise, this device may act in a similar manner to that described above with reference to FIGS. 1 to 4.

Referring now to FIGS. 9 to 14, still further preferred embodiments of a protector device in accordance with the present invention are illustrated.

In FIGS. 9 to 14, the three dimensional protector device 10 includes a circular disc 11 of flat, thin and flexible spring material such as a metal or a plastics material with similar spring like characteristics. The device 10 has opposed film or web layers 40, 41 which are sealed together about a peripheral zone 42 to contain the layer 11 therein. Conveniently a smallish central opening 43 (FIG. 9), openings 44 (FIG. 11), or one larger central opening 45 (FIG. 13) may be provided to provide sufficient floatation for the protector disc device 10 to float on any liquid wine remaining in an opened bottle. The positioning, number and size of the openings may be variable with the desirable end result being that the disc member 10 can be introduced into an opened bottle of wine and thereafter recover a disc like shape to float in and generally cover the wine surface in the bottle.

FIGS. 20 to 22 show alternative configurations of thin and flexible spring material 11*a*. FIG. 20 shows a square-shaped polygon of the spring material 11*a*. FIG. 21 shows a triangular-shaped polygon of the spring material 11*a*. FIG. 22 shows a rectangular shaped configuration of the spring material 11*a*. As can be appreciated from FIGS. 20-22, corners of the polygonal shape of the spring material 11*a* are positionable adjacent to but inwardly of an internal wall surface of the body region of the wine bottle 12.

Referring now to FIGS. 15*a*/15*b*, a still further preferred embodiment is illustrated of a three dimensionally shaped protector device 10 having a central zone 46 and a peripheral edge zone 42. This embodiment may include a central spring material layer that may be a spring grade metal or plastics type material as with the other illustrated embodiments. In this case a layer of liquid resistant plastics material 47 is laid over the central spring material layer on either side which has a specific gravity less than wine on which it is intended to float, the material being such as to not react with the wine in any way to affect its taste or any other characteristics. The outer plastics material 47 may further have another thin layer located outwardly of the plastics material 47 adopted to contact the remaining wine in an opened wine bottle. Conveniently the material 47 is pressed to provide one larger or a plurality of smaller spaced dimples 48 as illustrated to assist with flotation. In the same operation, the peripheral edge zone 42 might also be pressed to form a very thin flexible zone that is adopted, in use, to engage the inside surface of a wine bottle. The edge zone 42 might be radially separated at 49 during the pressing step to increase the flexibility of the edge zone. Alternatively, the edge zone 42 might be scalloped for a similar reason. It will of course be appreciated that the central spring material layer can be omitted if the material 47 is capable of providing the same characteristics.

Figure 16A:
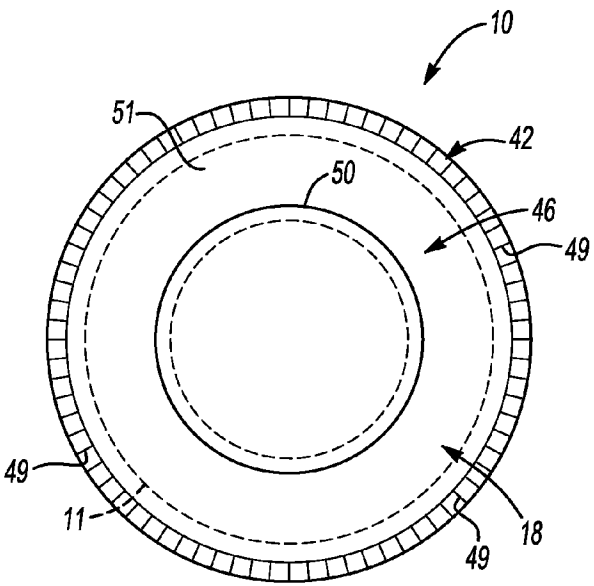
Figure 16B:
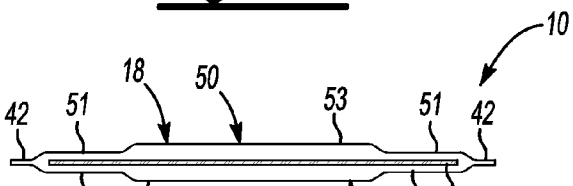

FIGS. 16*a*/16*b* illustrate another possible preferred design of a three dimensionally shaped protector device 10 according to the present invention. In this embodiment, the construction may be similar to that which is discussed above in relation to FIGS. 15*a*/15*b*. In this case one central thickened region 50 is provided on either side with a thinner peripheral zone 51 leading to the preferably thin edge zone 42. Again the edge zone might be die cut radially to achieve a fringe arrangement or scalloped as with the embodiment of FIGS. 15*a*/15*b*. The protector member 10 may be stamped or pressed to the shape illustrated which in practice will be quite thin, it being illustrated thicker in the annexed drawings for the sake of clarity. Again, an outer plastics material membrane 53 may be provided on either side of the floatation providing material 47 if required.

Figure 17A:
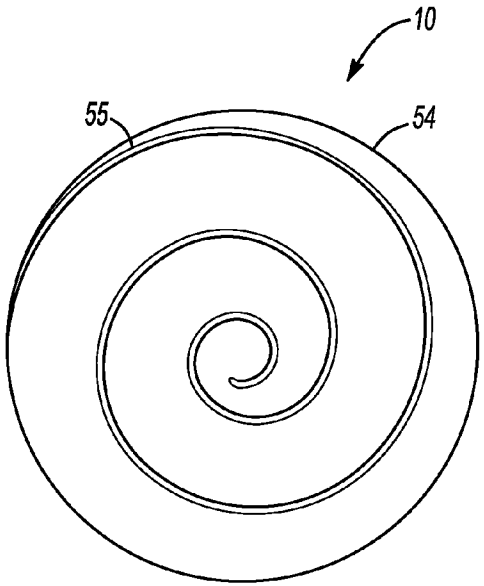
Figure 17B:
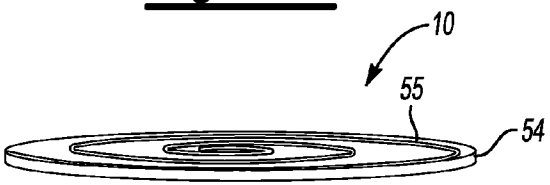

Referring to FIGS. 17*a*/17*b*, yet another preferred embodiment is shown of a protection device 10 according to the present invention. The disc like member 54 in its free state (illustrated) is conveniently made from a single material or a composite material as with previously described embodiments. In this embodiment, however, a three dimensional configuration is established by die cutting a spiral separation line 55 through the disc like member 54. In this case the spiral may be unwound to allow insertion of the device 10 through the neck of a wine bottle but the material or materials of the disc like member 54 permit it to reform to the illustrated position once inside the bottle and free of deforming faces thereon. Again the material or materials of the device 10 must allow it to float on top of wine remaining in a wine bottle and also to allow it to reform as described above. It will of course be appreciated that this embodiment might also include a peripheral edge zone 42 as with FIGS. 15*a*/15*b* and 16*a*/16*b*.

It will of course be appreciated that many further variations or modifications might be made to the protection device as described above without departing from the general concept defined in the claims annexed hereto. For example, the protector device might be made from a plurality of segments each being movable relative to an adjacent said segment and being expandable within the bottle to form a covering disc shape. The segments might be formed from bubble wrap like material for floatation purposes and a thin sheet of flexible spring material to enable recovery of the disc like shape.

The invention claimed is:

1. A wine protector device adapted, in use, to protect wine in an opened wine bottle having a neck region and a body region, said wine protector device being formed in a first expanded condition as a disc member having an outer peripheral edge zone approximating the internal cross-sectional dimensions of the body region of the opened wine bottle, said protector device being flexibly deformable to enable introduction through the neck region of the opened wine bottle and once in the body region being recoverable in shape to said first expanded condition to be located on the wine surface of wine remaining in the body region, whereby a barrier is established restricting air contact with the remaining wine in the opened wine bottle, said wine protector device having a multi part construction including an inner thin sheet of spring material that is flexibly deformable by rolling or folding but returns to a substantially flat disposition once external deforming forces are removed, said thin sheet of spring material being located between two outer zones of plastics material connected to one another to contain said thin sheet of spring material therebetween in a sealed zone, said device further including a peripheral edge zone extending circumferentially and radially that is relatively more flexible than remaining regions of said device, wherein said peripheral edge zone includes a plurality of cuts or similar separation lines extending from a peripheral outer edge inwardly of said device.

2. A wine protector device adapted, in use, to protect wine in an opened wine bottle having a neck region and a body region, said wine protector device being formed in a first expanded condition as a disc member having an outer peripheral edge zone approximating the internal cross-sectional dimensions of the body region of the opened wine bottle, said protector device being flexibly deformable to enable introduction through the neck region of the opened wine bottle and once in the body region being recoverable in shape to said first expanded condition to be located on the wine surface of wine remaining in the body region, whereby a barrier is established restriction air contact with the remaining wine in the opened wine bottle, said wine protector device having a multi part construction including an inner thin sheet of spring material that is flexibly deformable by rolling or folding but returns to a substantially flat disposition once external deforming threes are removed, said thin sheet of spring material being located between two outer zones of plastics material connected to one another to contain said thin sheet of spring material therebetween in a sealed zone, wherein said thin sheet of spring material comprises a disc having a substantially circular perimeter, a diameter of said disc being less than a diameter of the body region of the opened wine bottle in which it is to be used.

3. A wine protector device according to claim 2, wherein said thin sheet of spring material is a metal material.

4. A wine protector device according to claim 2, wherein said thin sheet of spring material is a plastics material.

5. A wine protector device according to claim 1, wherein said thin sheet of spring material has a polygonal shaped perimeter wherein, in use, all corners of the polygonal shape are positionable adjacent to but inwardly of an internal wall surface of the body region of the wine bottle.

6. A wine protector device according to claim 5, wherein said thin sheet of spring material has one of a triangular, square or rectangular shape.

7. A wine protector device according to claim 2, wherein said thin sheet of spring material has at least one opening within a peripheral edge region.

8. A wine protector device according to claim 2, wherein, said thin outer zones of plastics material are formed by two webs of plastics material film sealed to one another at a peripheral seal zone to contain said thin sheet of spring material therebetween.

9. A wine protector device according to claim 8, wherein said webs of plastics material film are made from thermoplastics material which are heat scaled together to form said peripheral seal zone, said thermoplastics material also being non-reactive to wine.

10. A wine protector device adapted, in use, to protect wine in an opened wine bottle having a neck region and a body region, said wine protector device being formed in a first expanded condition as a disc member having an outer peripheral edge zone approximating the internal cross-sectional dimensions of the body region of the opened wine bottle, said protector device being flexibly deformable to enable introduction through the neck region of the opened wine bottle and once in the body region being recoverable in shape to said first expanded condition to be located on the wine surface of wine remaining in the body region, whereby a barrier is established restricting air contact with the remaining wine in the opened wine bottle, said wine protector device having a multi part construction including an inner thin sheet of spring material that is flexibly deformable by rolling or folding but returns to a substantially flat disposition once external deforming forces are removed, said thin sheet of spring material being located between two outer zones of plastics material connected to one another to contain said thin sheet of spring material therebetween in a sealed zone; and floatation means to ensure said device, in use, floats on the wine surface in the opened wine bottle.

11. A wine protector device according to claim 10, wherein said floatation means is located between said outer zones of plastics material.

12. A wine protector device according to claim 10, wherein said floatation means is at least one floatation bag, sack or region containing air.

13. A wine protector device according to claim 10, wherein said floatation means includes a floatation material that includes at least one thicker region with at least one thinner region adjacent said at least one thicker region.

14. A wine protector device according to claim 13, wherein said floatation means is provided on opposed sides of said thin sheet of spring material.

15. A wine protector device adapted, in use, to protect wine in an opened wine bottle having a neck region and a body region, said wine protector device being formed in a first expanded condition as a disc member having an outer peripheral edge zone approximating the internal cross-sectional dimensions of the body region of the opened wine bottle, said protector device being flexibly deformable to enable introduction through the neck region of the opened wine bottle and once in the body region being recoverable in shape to said first expanded condition to be located on the wine surface of wine remaining in the body region, whereby a barrier is established restricting air contact with the remaining wine in the opened wine bottle, said wine protector device having a multi part construction including an inner thin sheet of spring material that is flexibly deformable by rolling or folding but returns to a substantially flat disposition once external deforming forces are removed, said thin sheet of spring material being located between two outer zones of plastics material connected to one another to contain said thin sheet of spring material therebetween in a sealed zone, wherein said device includes weight means to ensure said device, in use, settles into the wine surface in the opened wine bottle.

16. A wine protector device according to claim 15, wherein said weight means is a liquid or gel.

17. A wine protector device adapted, in use, to protect wine in an opened wine bottle having a neck region and a body region, said wine protector device being formed in a first expanded condition as a disc member having an outer peripheral edge zone approximating the internal cross-sectional dimensions of the body region of the opened wine bottle, said protector device being flexibly deformable to enable introduction through the neck region of the opened wine bottle and once in the body region being recoverable in shape to said first expanded condition to be located on the wine surface of wine remaining in the body region, whereby a barrier is established restricting air contact with the remaining wine in the opened wine bottle, said wine protector device having a multi part construction including an inner thin sheet of spring material that is flexibly deformable by rolling or folding but returns to a substantially flat disposition once external deforming forces are removed, said thin sheet of spring material being located between two outer zones of plastics material connected to one another to contain said thin sheet of spring material therebetween in a sealed zone; and comprising a peripheral edge zone that extends circumferentially and is thinner than remaining regions of said device whereby said peripheral edge zone has increased relative flexibility.

18. A wine protector device according to claim 17, wherein said peripheral edge zone includes a plurality of cuts or similar separation lines extending from a peripheral outer edge inwardly of said device.

19. A wine protector device according to claim 18, wherein said cuts or similar separation lines extend radially.

20. A wine protector device according to claim 17, wherein said peripheral edge zone includes a scalloped peripheral outer edge.

21. A wine protector device adapted, in use, to protect wine in an opened wine bottle having a neck region and a body region, said wine protector device being formed in a first expanded condition as a disc member having an outer peripheral edge zone approximating the internal cross-sectional dimensions of the body region of the opened wine bottle, said protector device being flexibly deformable to enable introduction through the neck region of the opened wine bottle and once in said body region being recoverable in shape to said first expanded condition to be located on the wine surface of wine remaining in the body region, whereby a harrier is established restricting air contact with the remaining wine in the opened wine bottle, wherein said disc member includes a peripheral edge zone that extends circumferentially and is thinner than remaining regions of said disc member whereby said peripheral edge zone has increased relative flexibility, wherein said peripheral edge zone includes a plurality of cuts or similar separation lines extending from a peripheral outer edge inwardly toward said disc member.

* * * * *

UNITED STATES PATENT AND TRADEMARK OFFICE

CERTIFICATE OF CORRECTION

PATENT NO. : 8,365,931 B2
APPLICATION NO. : 11/574264
DATED : February 5, 2013
INVENTOR(S) : Rees et al.

It is certified that error appears in the above-identified patent and that said Letters Patent is hereby corrected as shown below:

IN THE CLAIMS:

Claim 21, Column 8, Line 34: “harrier” should read as --barrier--

Signed and Sealed this
Twenty-eighth Day of May, 2013

Teresa Stanek Rea
*Acting Director of the United States Patent and Trademark Office*